US006203476B1

(12) United States Patent
Wang et al.

(10) Patent No.: US 6,203,476 B1
(45) Date of Patent: Mar. 20, 2001

(54) PHYSICAL EXERCISING APPARATUS

(75) Inventors: Mei-San Wang, Panchiao; Winson Ouyang, Sanchung, both of (TW)

(73) Assignee: Allen Yin, Taipei (TW)

( * ) Notice: Subject to any disclaimer, the term of this patent is extended or adjusted under 35 U.S.C. 154(b) by 0 days.

(21) Appl. No.: 09/443,314

(22) Filed: Nov. 19, 1999

(51) Int. Cl.[7] ..... A63B 21/00
(52) U.S. Cl. ..... 482/121; 482/132; 482/123
(58) Field of Search ..... 482/121, 122, 482/95, 96, 114, 116, 123, 126, 131, 132, 135

(56) References Cited

U.S. PATENT DOCUMENTS 5,261,866 * 11/1993 Mattox ..... 482/125
5,499,961 * 3/1996 Mattox ..... 482/130
6,010,430 * 1/2000 Mankovitz ..... 482/132
6,071,217 * 6/2000 Barnett ..... 482/121

* cited by examiner

*Primary Examiner*—Jerome Donnelly
(74) *Attorney, Agent, or Firm*—Varndell & Varndell, PLLC

(57) ABSTRACT

A physical exercising apparatus, which includes a first transverse frame bar having a longitudinal center through hole, a second transverse frame bars, two wheels respectively mounted on the wheel holders for supporting the second transverse frame bar on the floor, and an elastic cord member inserted through the longitudinal center through hole on the first transverse frame bar and connected between the wheel holders for stretching by the user when the user holds the first transverse frame bar in place and moves the second transverse frame bar relative to the first transverse frame bar.

1 Claim, 13 Drawing Sheets

PHYSICAL EXERCISING APPARATUS

BACKGROUND AND SUMMARY OF THE INVENTION

The present invention relates to physical exercising apparatus, and more particularly to a simple structure of damping force adjustable physical exercising apparatus, which is practical for exercising the hands, the hip, the waist, the back, the legs, the feet, as well as the knees.

FIG. 1 shows a physical exercising apparatus, which comprises a wheel, two handlebars fixedly fastened to the wheel at two opposite sides, an elastic cord member having two opposite ends respectively fastened to the handlebars, and two cushion blocks fixedly provided at the elastic cord member. When in use the knees are stopped at the cushion blocks, and wheel is moved back and forth with the hands to stretch and release the elastic cord member alternatively. This structure of physical exercising apparatus has drawbacks as follows:

1. Because the two handlebars are disposed close to each other, the user tends to fall sideways to the floor when reciprocating the wheel.

2. Because the length of the elastic cord member is not adjustable, the user can not adjust the damping force as desired.

3. When operating the physical exercising apparatus, the user's knee may slip on the cushion blocks.

4. The physical exercising apparatus provide limited operation modes.

The present invention provide a physical exercising apparatus, which eliminates the aforesaid drawbacks. According to one aspect of the present invention, the physical exercising apparatus comprises a first transverse frame bar having a longitudinal center through hole, a second transverse frame bar, two wheel holders fixedly fastened to two opposite ends of the second transverse frame bars, two wheels respectively mounted on the wheel holders for supporting the second transverse frame bar on the floor, and an elastic cord member inserted through the longitudinal center through hole on the first transverse frame bar when the user holds the first transverse frame bar in place and moves the second transverse frame bar relative to the first transverse frame bar to exercise different parts of the body. According to another aspect of the Present invention, the two distal ends of the elastic cord member can be respectively wound round the base of each wheel holder and secured in position to adjust the length of the elastic cord member. According to still another aspect of the present invention, the length of the second transverse frame bar is greater than the shoulder width, so that the second transverse frame bar can be moved with the wheel holders and the wheels back and forth stably on the floor relative to the first transverse frame bar without causing the user to fall to the floor.

DETAILED DESCRIPTION OF THE PREFERRED EMBODIMENT

Figure 1:
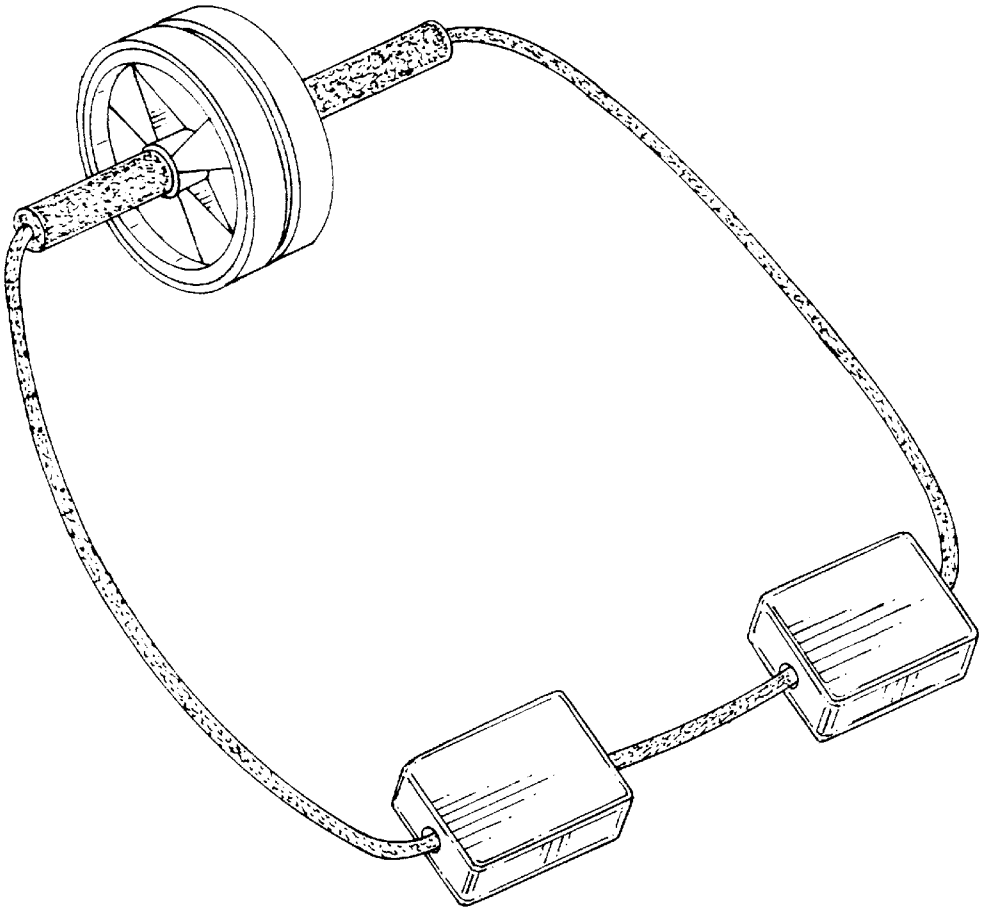
Fig.1 PRIOR ART
FIG. 1 illustrates a physical exercising apparatus according to the prior art.
Figure 2:
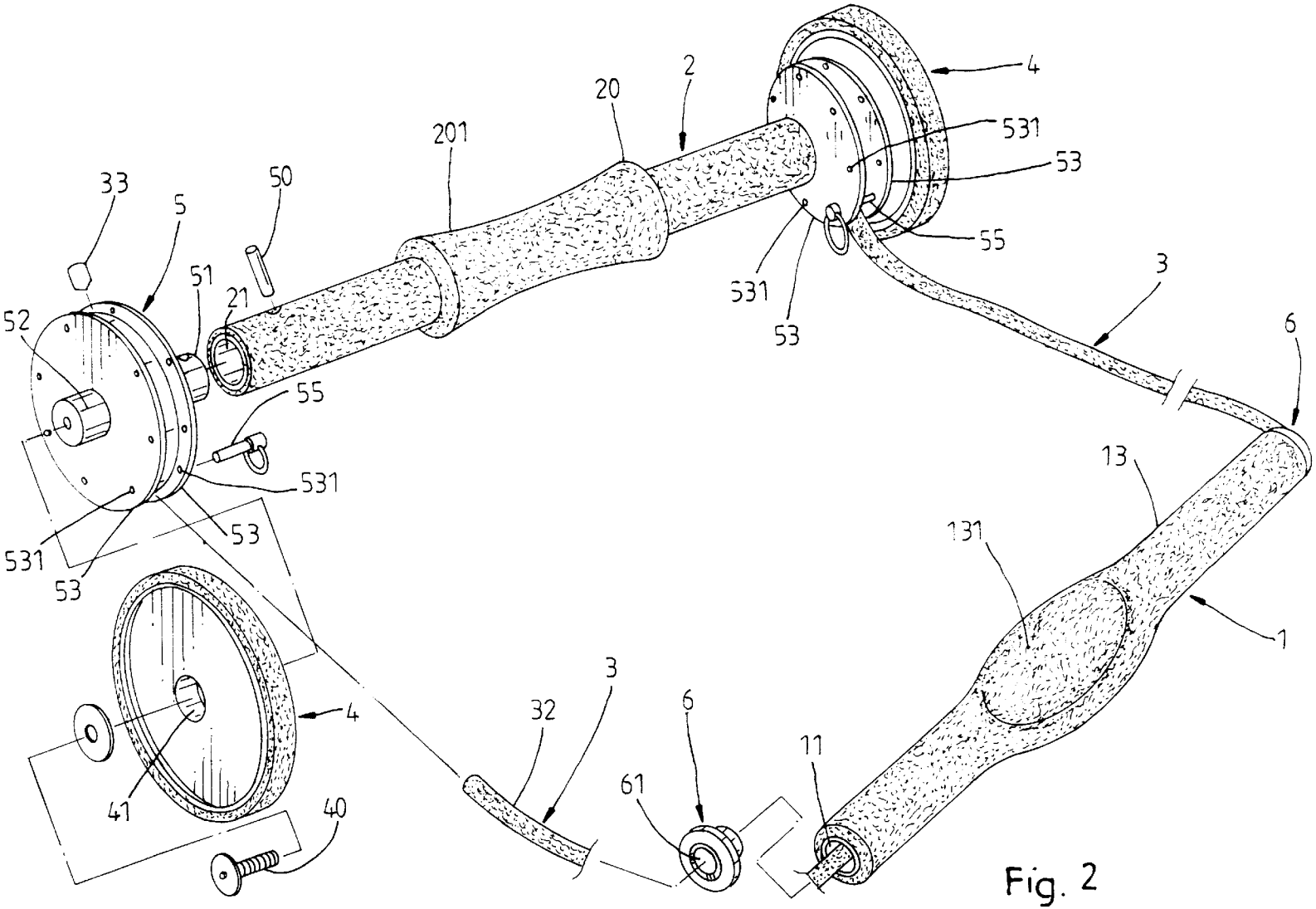
FIG. 2 is an exploded view of a physical exercising apparatus according to the present invention.
Figure 3:
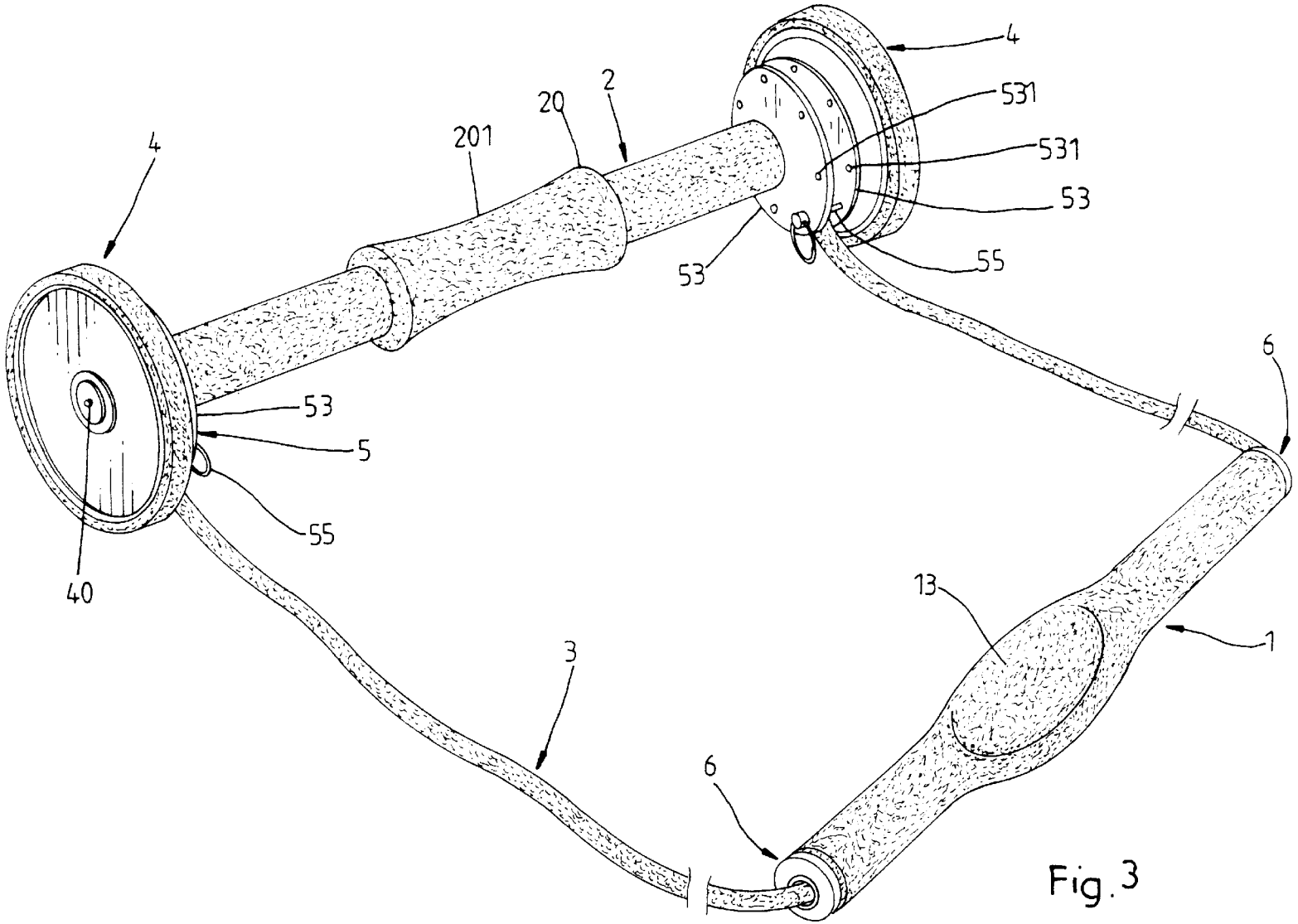
FIG. 3 is a perspective assembly view of the physical exercising apparatus shown in FIG. 2.
Figure 4:
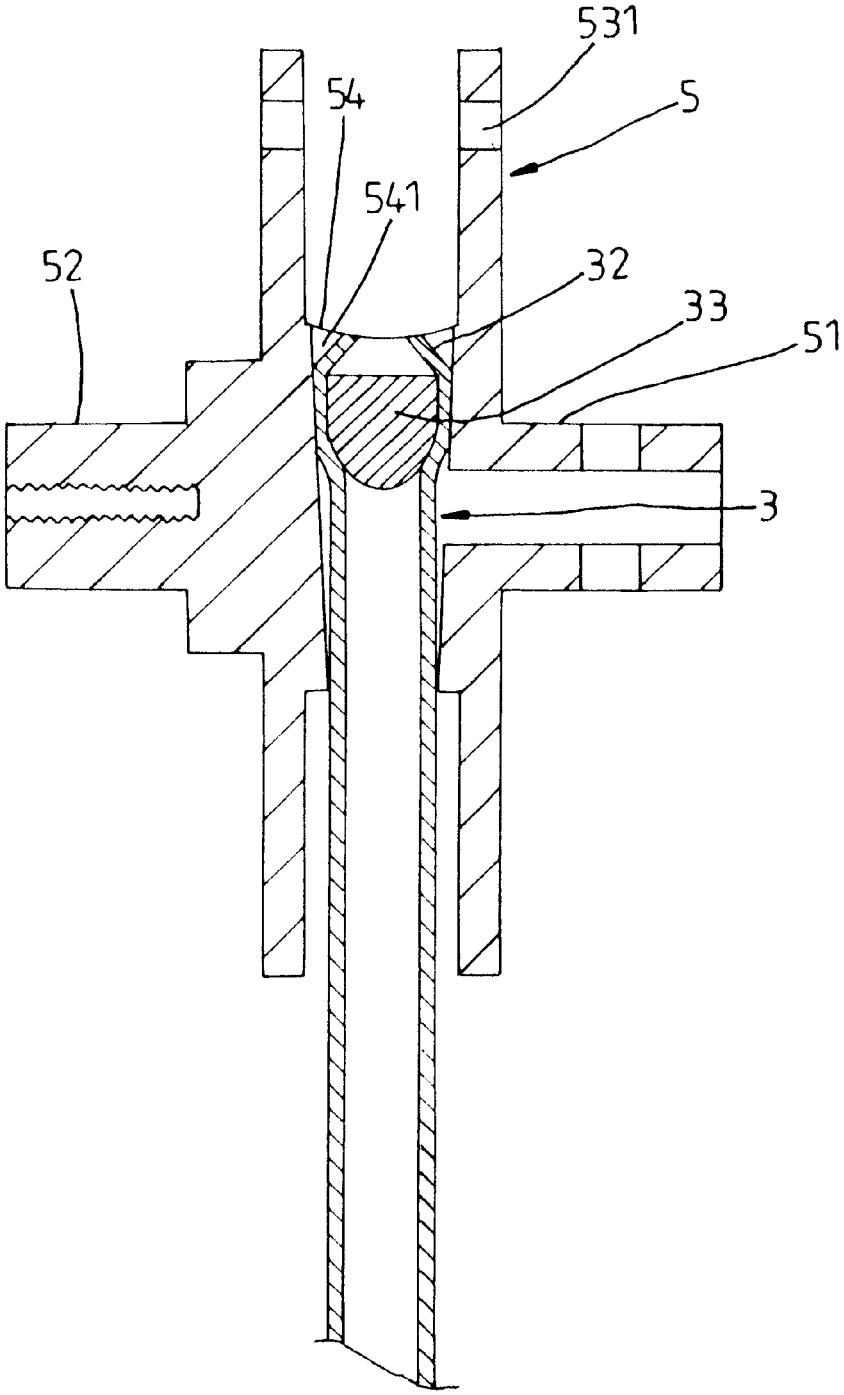
FIG. 4 is a sectional view of a part of the present invention.

Referring to FIGS. from 2 through 4, a physical exercising apparatus in accordance with the present invention is generally comprised of a first transverse frame bar 1, a second transverse frame bar 2, an elastic cord member 3, two wheels 4, two wheel holders 5, and two end caps 6

The first transverse frame bar 1 is a hollow cylindrical bar having a longitudinal center through hole 11 through the length thereof, and a soft covering 13 covered on the outside wall thereof. The soft covering 13 has a recessed portion 131 on the expanded middle part thereof. The end caps 6 are respectively fastened to two distal ends of the longitudinal center through hole 11, each having a center through hole 61. The elastic cord member 3 is inserted through the center through hole 61 on each end cap 6 and the longitudinal center through hole 11 on the first transverse frame bar 1, having two distal ends 32 respectively fastened to the wheel holders 5. The second transverse frame bar 2 comprises two plug holes 21 respectively formed on two distal ends thereof for holding the wheel holders 5, and a soft, cylindrical cushion 20 on the middle. The cylindrical cushion 20 has an outer diameter 201 gradually increased from the middle toward two distal ends thereof. The wheels 4 are respectively coupled to the wheel holders 5, each comprising a center axle hole 41. The wheel holders 5 each comprise a base 54, a first axle 51 perpendicularly raised from the center of one side wall of the base 54 and fitted into the Plug hole 21 on one end of the second transverse frame bar 2 and fixed thereto by a respective lock pin 50, a second axle 52 perpendicularly raised from the center of the opposite side wall of the base 54 and inserted into the center axle hole 41 on one wheel 4 and secured thereto by a respective screw bolt 40, two outward flanges 53 raised around the periphery of the base 54 and disposed in flush with the two opposite side walls of the base 54, a plurality of pin holes 531 symmetrically disposed on the outward flanges 53, a cord member mounting hole 541 formed on the periphery of the base 54 between the outward flanges 53 for receiving one end 32 of the elastic cord member 3, and a tightening up element 33 fastened to the cord member mounting hole 541 to fix on end 32 of the elastic cord member 3 in place. After installation of the two distal ends 32 of the elastic cord member 3 in the cord member mounting hole 541 on the base 54 of each wheel holder 5, the elastic cord member 3 can be wound round the base 54 of each wheel holder 5 to shorten the distance between the first transverse frame 1 and the the second transverse frame bar 2. After adjustment of the distance between the first transverse frame bar 1 and the second transverse frame bar 2, a respective locating pin 55 is selectively fastened to the pin holes 531 on each wheel holder 5 to keep the winding of the elastic cord member 3 in place. Further, the length of the second transverse frame bar 2 must be greater than the shoulder width.

The physical exercising apparatus can be operated in any of a variety manners as shown in FIGS. from 7 through 13. When in use, the feet or knees are stopped at the first transverse frame bar 1 (or the second transverse frame bar 2), and the second transverse bar 2 (or the first transverse frame bar 1) is pushed by the waist, hands or shoulders and then released, causing the elastic cord member 3 to be alternatively stretched and released, and therefore the muscles of different parts of the body are exercised.

Figure 5:
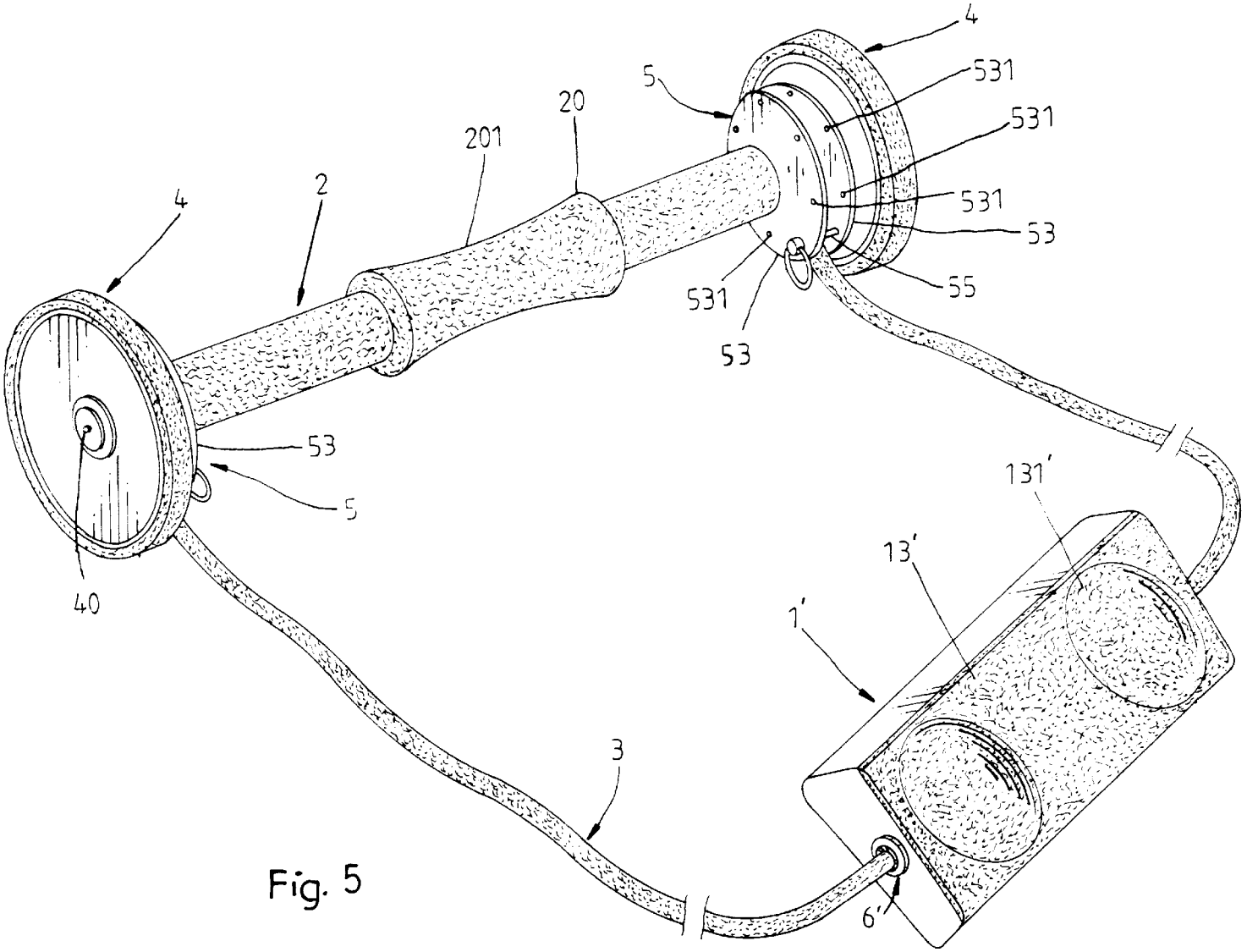
FIG. 5 is a perspective view of an alternate form of the present invention.
Figure 6:
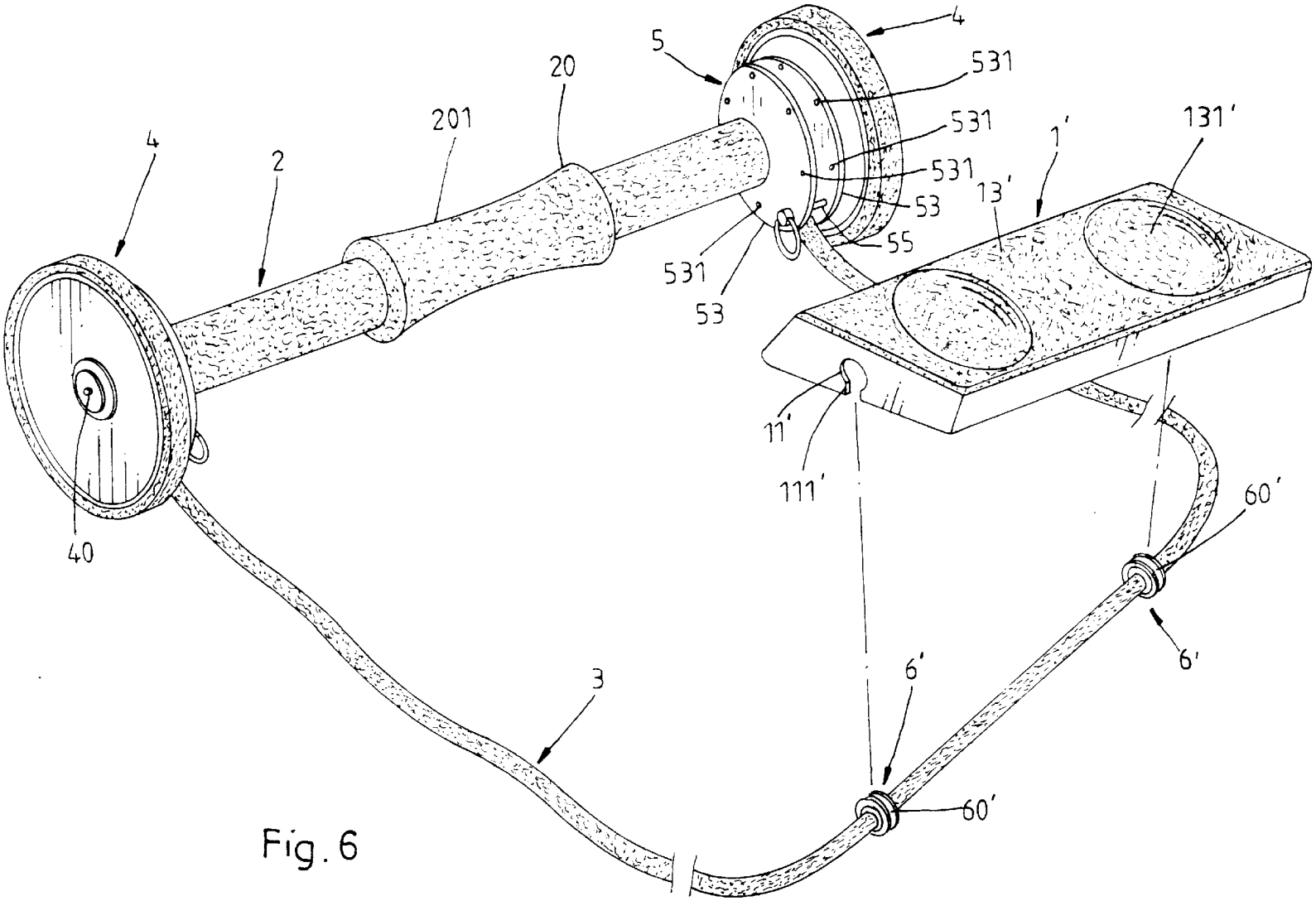
FIG. 6 is an exploded view of the physical exercising apparatus shown in FIG. 5.
Figure 7:
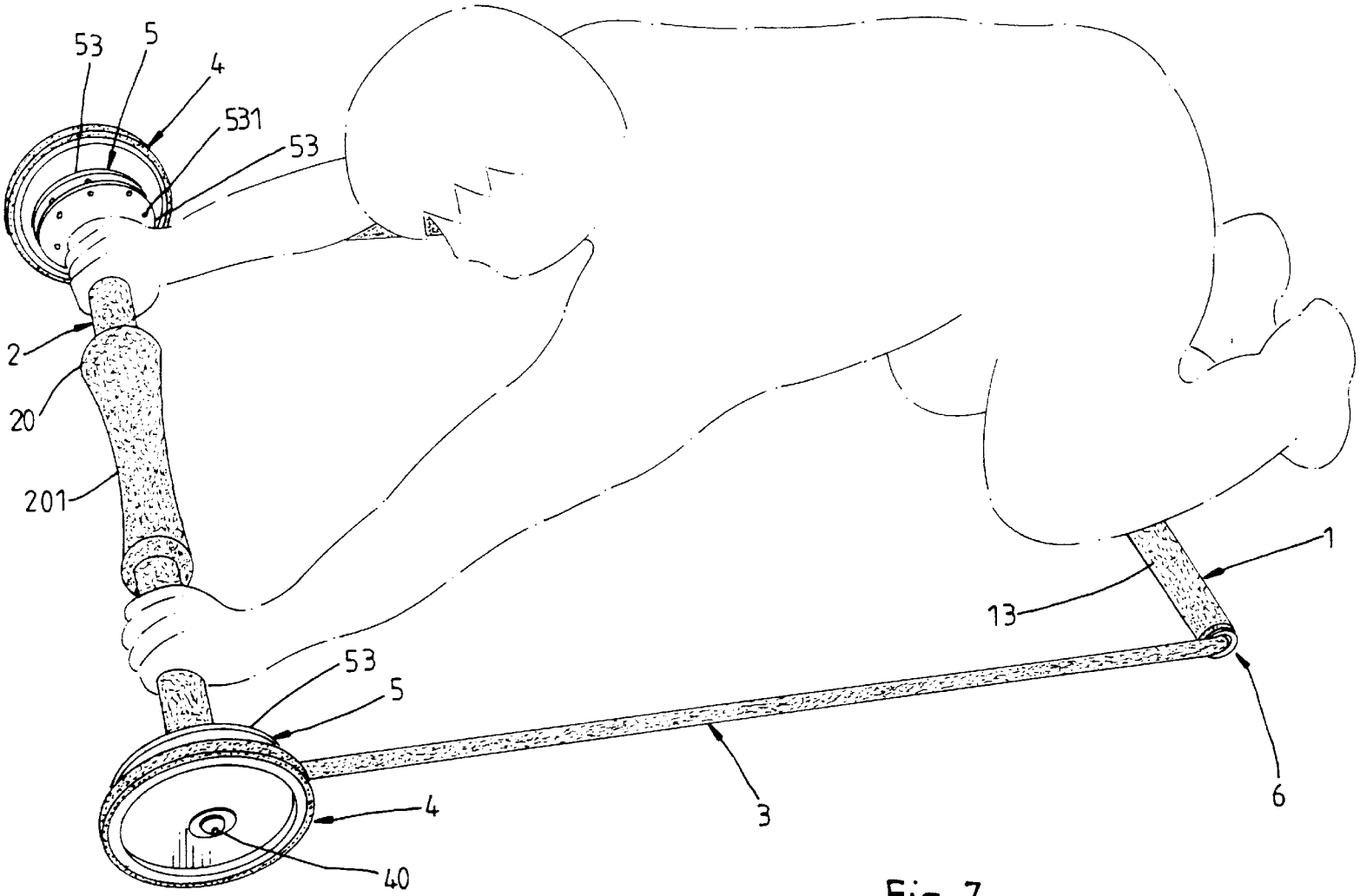
FIG. 7 shows one application example of the present invention.
Figure 8:
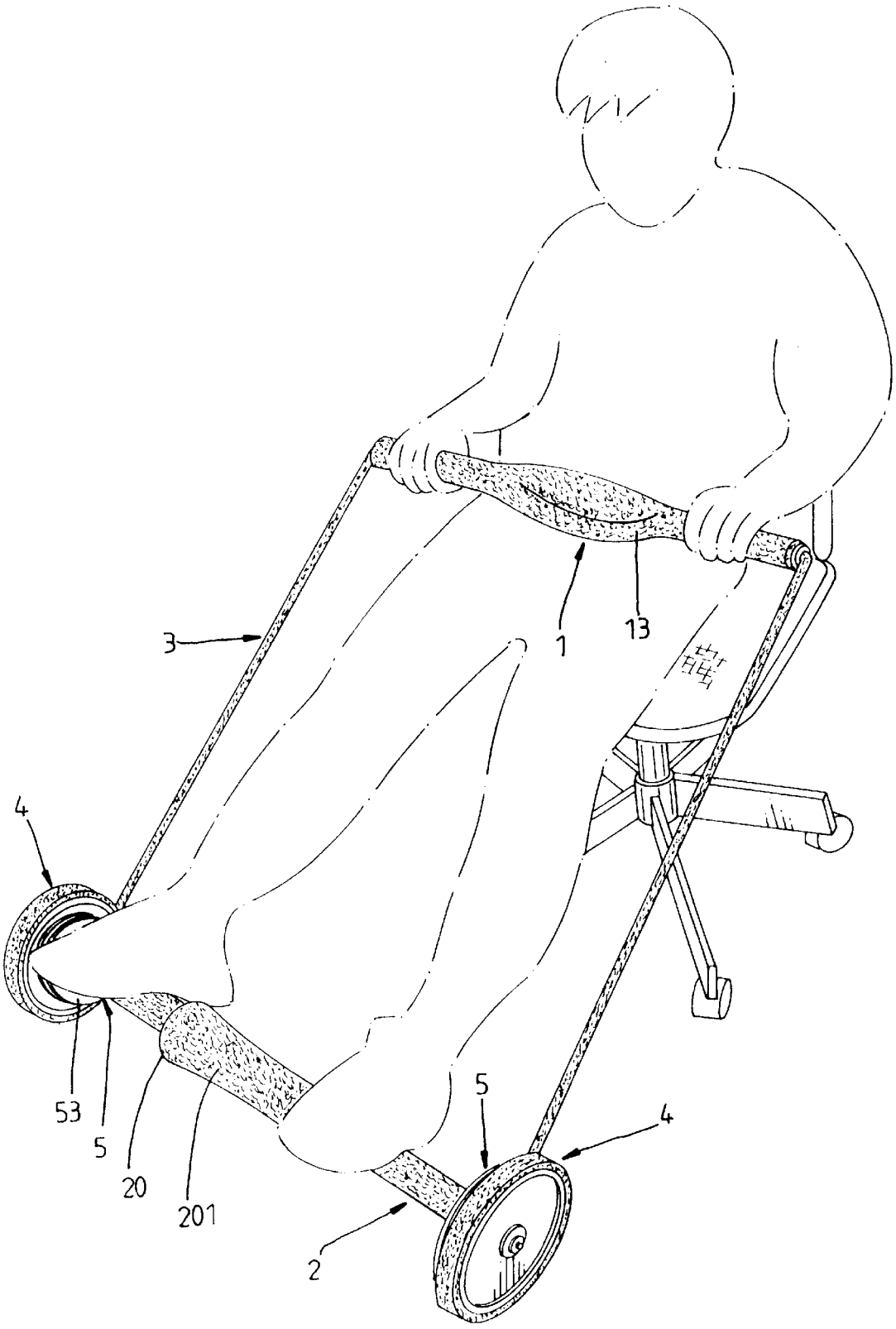
FIG. 8 shows another application example of the present invention.
Figure 9:
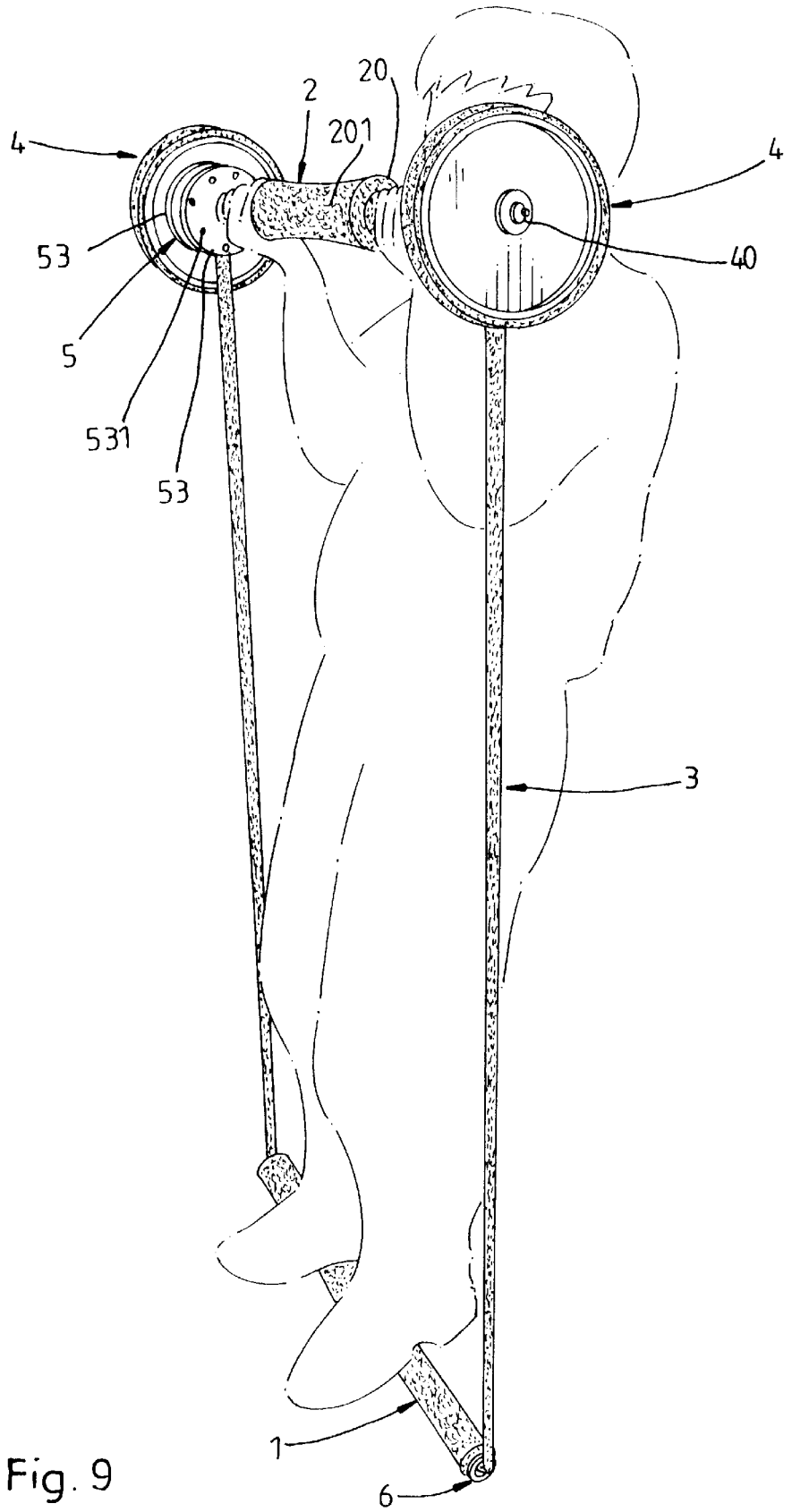
FIG. 9 shows still another application example of the present invention.
Figure 10:
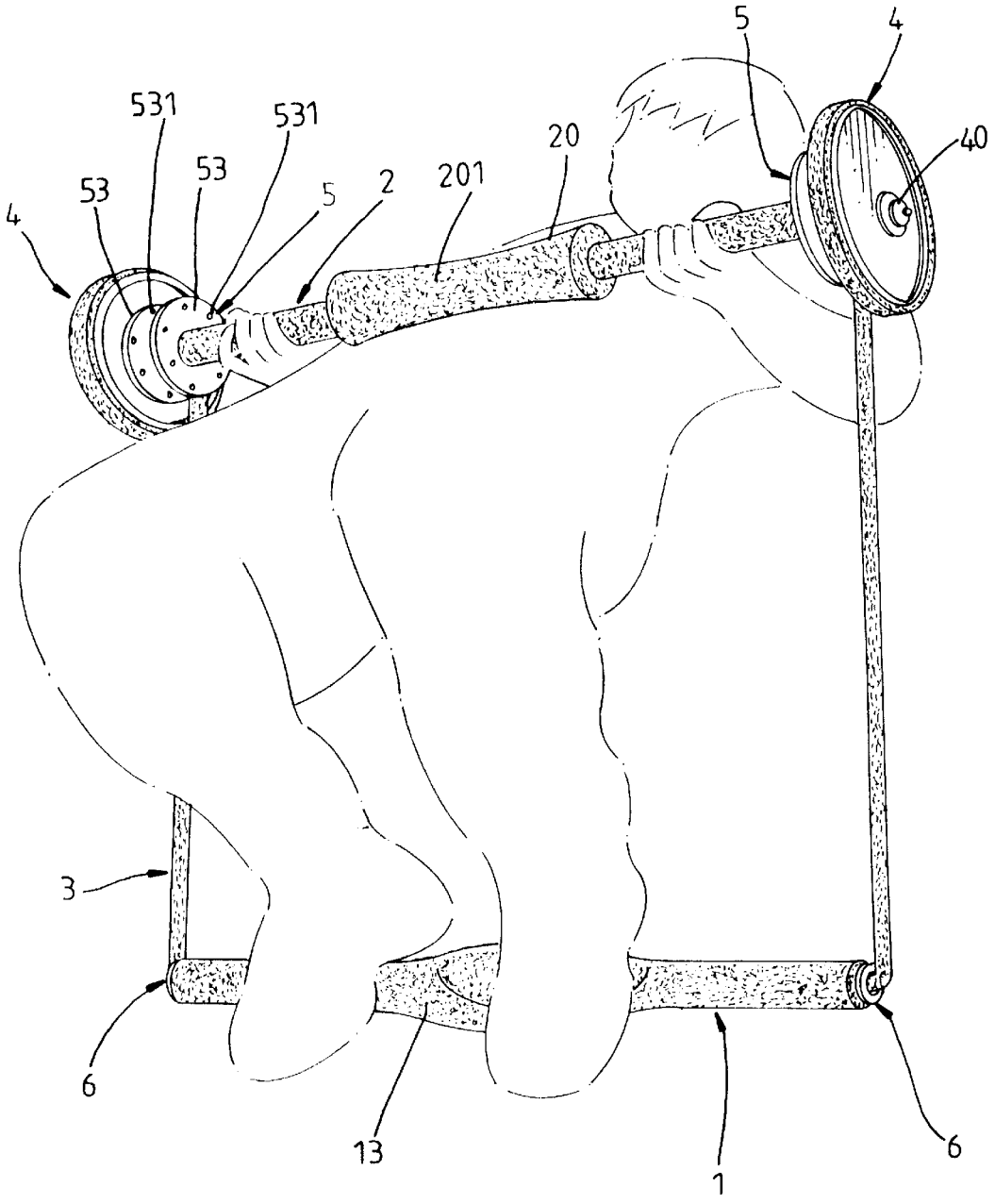
FIG. 10 shows still another application example of the present invention.
Figure 11:
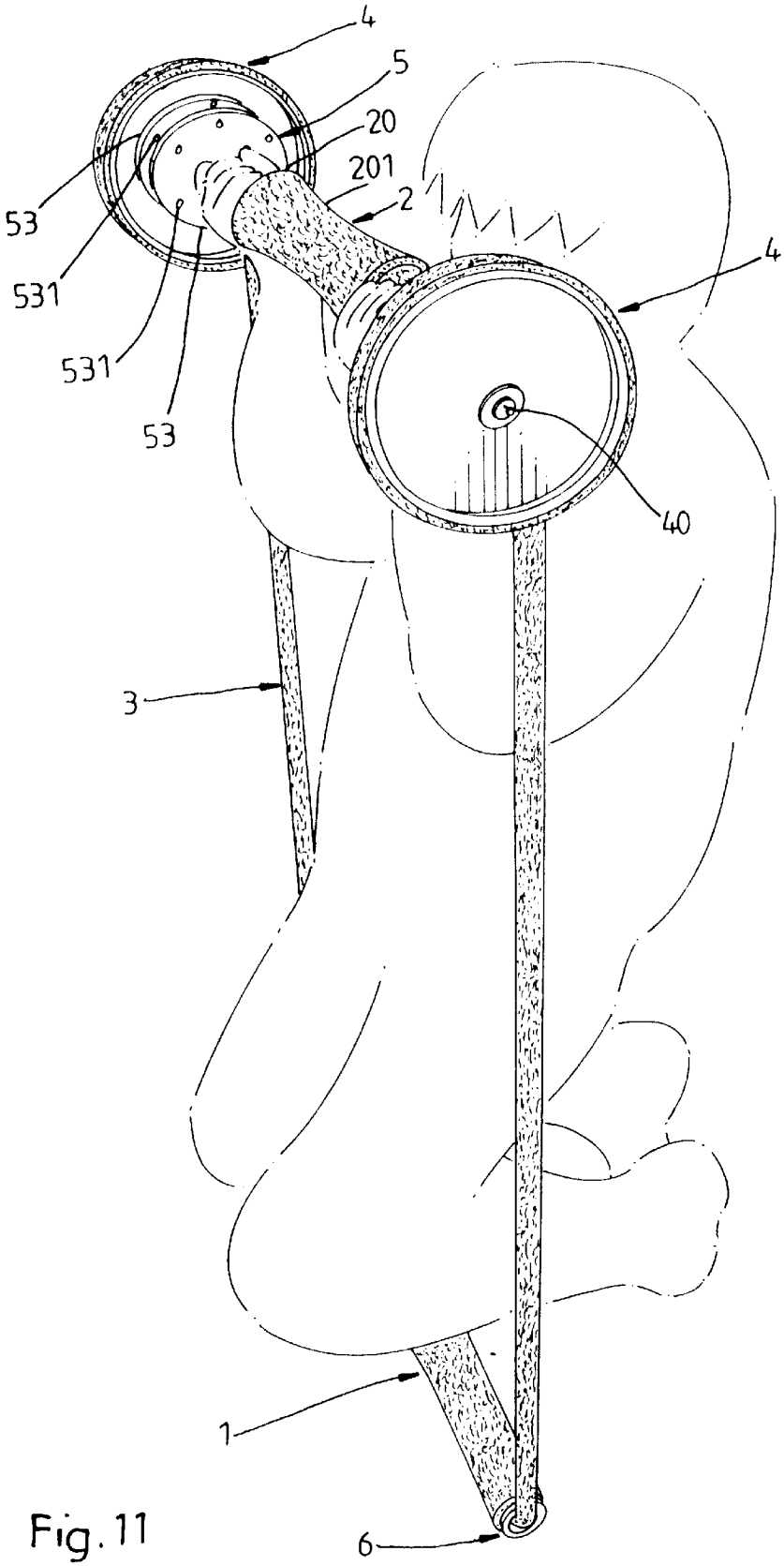
FIG. 11 shows still another application example of the present invention.
Figure 12:
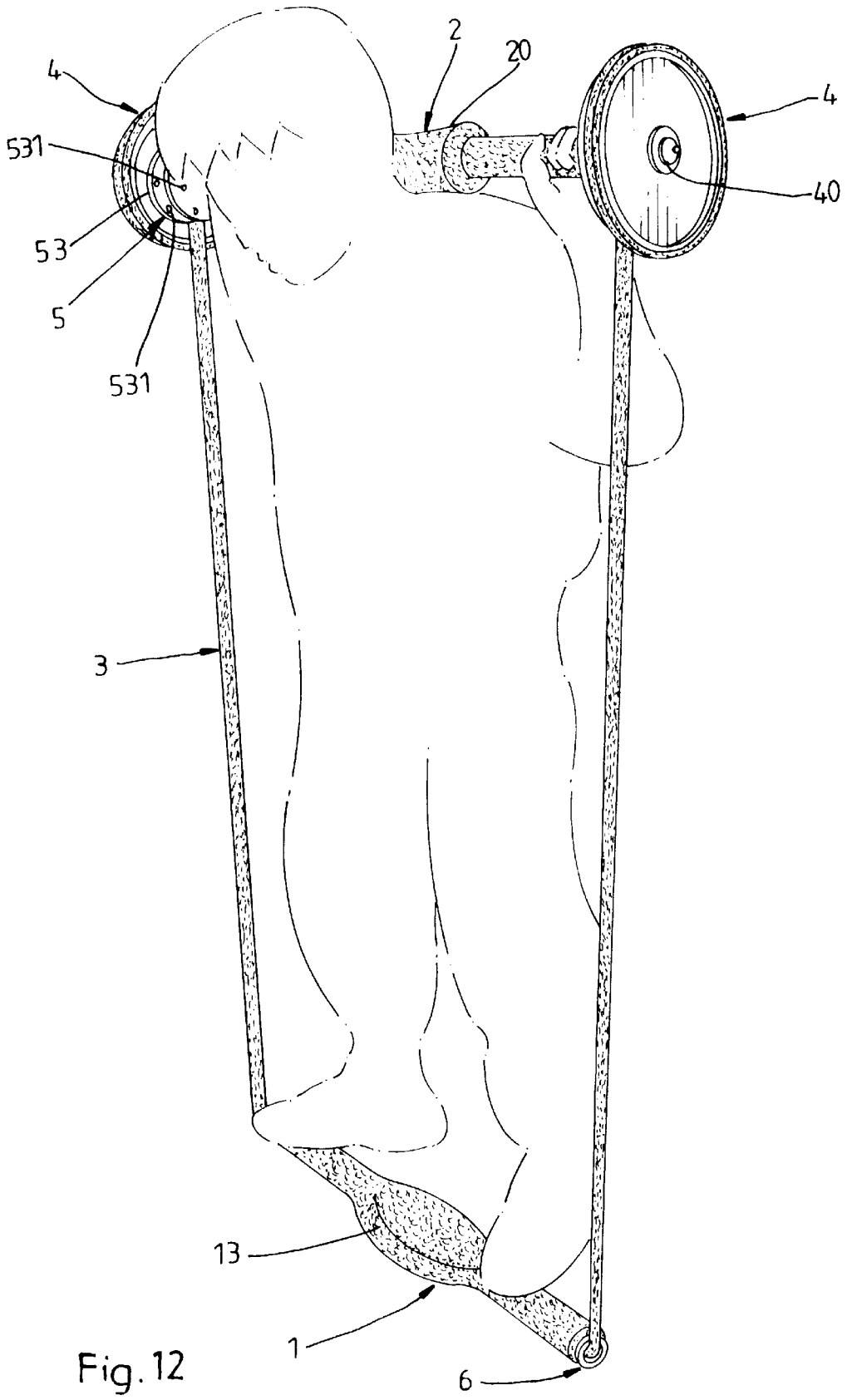
FIG. 12 shows still another application example of the present invention.
Figure 13:
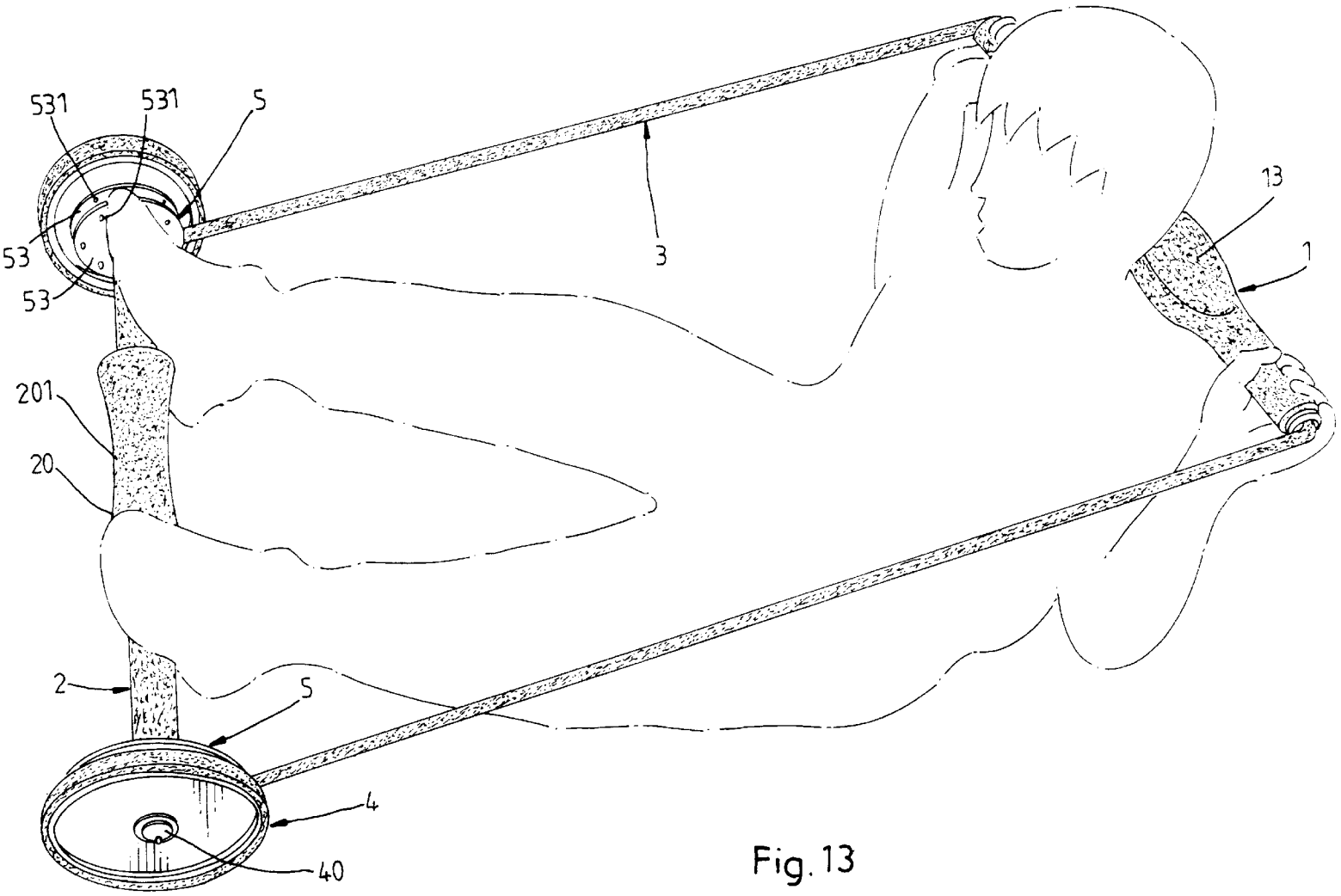
FIG. 13 shows still another application example of the present invention.

FIGS. 5 and 6 show an alternate form of the present invention. According to this alternate form, the first transverse frame bar 1' is a flat member having two recessed portions 131' on the top side wall of the soft covering thereof, two through holes 11' disposed on two opposite side walls thereof, and two bottom notches 111' respectively made on the two opposite side walls in communication with the bottom notches 111'. The end caps 6' are respectively forced through the bottom notches 111' into the through hole 11', each having a coupling groove 60' forced into engagement with the periphery of the respective through hole 11'.

As indicated above, the Physical exercising apparatus achieves the following advantages.

1. The user can hold down the first transverse frame bar 1 with the legs, feet, knees or waist, and then move the second transverse frame bar 2 with the hands, shoulders, etc., to stretch and release the elastic cord member 3 alternatively, so as to exercise different parts of the body.

2. The two distal ends 32 of the elastic cord member 3 can be respectively wound round the base 54 of each wheel holder 5 to shorten the length of the elastic cord member 3, so as to adjust the damping force of the physical exercising apparatus as desired. After adjustment, the locating pine 55 are respectively fastened to the pin holes 531 on each wheel holder 5 to keep the winding of the elastic cord member 3 in place.

3. Because the wheels 4 are provides at two opposite ends of the second transverse frame bar 2 and the length of the second transverse frame bar 2 is greater than the user's shoulder width, the user does not fall sideways to the floor when moving the second transverse frame bar 2 back and forth on the floor.

What is claimed is:

1. A physical exercising apparatus comprising:

a first transverse frame bar, said first transverse frame bar comprising a longitudinal center through hole through the length thereof, and a soft covering covered on an outside wall thereof;

two end caps respectively fastened to the longitudinal center through hole on said first transverse frame bar at two opposite ends, said end caps each having a center through hole;

a second transverse frame bar, said second transverse frame bar comprising two plug holes respectively formed on two distal ends thereof, and a soft, cylindrical cushion mounted around the periphery thereof on the middle, said cylindrical cushion having an outer diameter gradually increased from the middle toward two distal ends thereof;

two wheel holders respectively coupled to the two distal ends of said second transverse frame bar, said wheel holders each comprising a base, a first axle perpendicularly raised from said base at one side and fitted into the plug hole on one end of said second transverse frame bar and fixed thereto by a respective lock pin, a second axle perpendicularly raised from said base at an opposite side, two outward flanges raised around the periphery of said base, a plurality of pin holes symmetrically disposed on said outward flanges, a cord member mounting hole formed on the periphery of said base between said outward flanges;

an elastic cord member inserted through the center through hole on each of said end caps and the longitudinal center through hole on said first transverse frame bar, said elastic cord member having two distal ends respectively inserted into the cord member mounting hole on the base of each of said wheel holders;

two tightening up elements respectively fastened to the cord member mounting hole on the base of each of said wheel holders to fix the two distal ends of said elastic cord member to said wheel holders;

two wheels respectively coupled to said wheel holders, said wheels each comprising a center axle hole coupled to the second axle of one wheel holder; and two screw bolts respectively fastened to the second axle of each of said wheel holders to secure said wheels to said wheel holders.

* * * * *